United States Patent [19]

Collins

[11] Patent Number: 4,964,554

[45] Date of Patent: Oct. 23, 1990

[54] LOCKING KNIFE AND SHEATH ASSEMBLY

[75] Inventor: Walter W. Collins, North, S.C.

[73] Assignee: A. G. Russell, Springdale, Ark.

[21] Appl. No.: 397,773

[22] Filed: Aug. 23, 1989

[51] Int. Cl.[5] ..... B26B 29/02

[52] U.S. Cl. ..... 224/232; 224/242; 224/252; 30/151

[58] Field of Search ..... 224/232, 233, 194, 182, 224/252, 253, 242; 30/151, 162, 143; 24/13, 710

[56] References Cited

U.S. PATENT DOCUMENTS

| | | | |
|---|---|---|---|
| 1,028,008 | 5/1912 | Eslick, Jr. | 30/151 |
| 2,098,139 | 11/1937 | Foley et al. | 224/232 |
| 2,391,574 | 12/1945 | Housinger | 30/151 |
| 2,527,710 | 10/1950 | Davidson, Jr. | 30/151 |
| 2,527,711 | 10/1950 | Davidson, Jr. | 30/151 |
| 2,618,057 | 11/1952 | Gibson | 30/151 |
| 2,721,340 | 10/1955 | Shultz | 30/151 |
| 2,783,536 | 3/1957 | McQueary | 30/151 |
| 2,793,434 | 5/1957 | Wigington | 30/151 |
| 2,839,831 | 6/1958 | Baer | 224/232 |
| 3,246,813 | 4/1966 | Miller | 224/232 |
| 3,958,330 | 5/1976 | Hutchens | 30/151 |
| 4,404,747 | 9/1983 | Collins | 30/151 |
| 4,558,516 | 12/1985 | Collins | 224/232 |
| 4,726,498 | 2/1988 | Esposito | 30/151 |
| 4,815,211 | 3/1989 | Garcia | 30/151 |

*Primary Examiner*—Linda J. Sholl

*Attorney, Agent, or Firm*—Michael A. Mann

[57] ABSTRACT

The present invention includes a knife and sheath assembly, the knife having a blade and a hilt with a guard, the sheath having a closed portion adapted to receive the blade and an open portion adapted to abut the hilt and guard. A bolt and a spring are slidably contained within a channel in the sheath. A portion of the bolt protrudes outwards from the channel and engages the side of the guard. The open portion of the sheath has a guide with a curved portion that causes the hilt of a knife being inserted to engage the bolt and move it from the locking position to the unlocking position until the knife is inserted far enough. Then a stepped portion of the guide causes the hilt to seat against the sheath and to disengage the bolt which slides to the locking position, thus preventing removal of the knife from the sheath by the cooperation of the sheath and the bolt. Pushing the bolt away into the channel releases the knife.

14 Claims, 4 Drawing Sheets

LOCKING KNIFE AND SHEATH ASSEMBLY

BACKGROUND OF THE INVENTION

1. Field of the Invention

The present invention relates to knife and sheath assemblies. More particularly, this invention relates to combinations of knives and sheaths that secure the knife in the sheath from accidental removal of the knife.

2. Discussion of Background

Most knife sheaths are designed simply to hold a knife within the sheath. It is sometimes desirable to prevent accidental removal of the knife by securing it within the sheath. There are sheaths that secure knives and there are knife and sheath combinations which, acting together, secure the knife in the sheath.

U S. Pat. No. 3,958,330 describes a sheath containing a stop. The finger guard of the knife rests on the stop, and the knife is held in place with a strap and snap fastener. A sheath with a fixed button or protruding member is disclosed in U.S. Pat. No. 3,246,813. When the knife is sheathed, the button extends over a portion of the knife guard to secure the knife within the sheath. Tilting the knife forward allows it to be removed from the sheath. U.S. Pat. Nos. 2,527,710 and 2,527,711 describe means of locking a knife in the sheath by the latching of a catch which passes through an opening in the guard of the knife. U.S. Pat. No. 4,404,747 describes a knife with a spring biased button in the knife handle. When the knife is inserted into the sheath, the button moves forward, positively locking into a hole in the sheath. The button must be depressed in order to remove the knife. U.S. Pat. No. 2,793,434 shows a knife with a spring latch which fits in a stepped recess in the top of the sheath. When the latch is squeezed, the knife can be rotated out of the sheath. U.S. Pat. No. 2,391,574 discloses a knife with a cutout portion on its handle to accommodate a spring arm which has a locking pin which seats in a notch on the sheath when the knife is inserted therein.

As is evident in the devices described above, there is a compromise between the securing of a knife in a sheath and the ease of removal of the knife. Furthermore, the compromise design is often obtained by a design of significant manufacturing complexity. Equipment used in outdoor sports must be rugged, simple to operate, and, in the case of a knife, rapidly accessible. Furthermore, the design of some sheaths does not prevent accidental release of a knife under all circumstances. A knife and sheath may be worn attached to a belt or placed in a pocket, but may also be packed with other equipment. A design which prevents accidental release when worn on a belt will not necessarily do so when carried in a pocket, or packed together with and jostled by other equipment and supplies.

There is a need for a knife and sheath assembly wherein the knife is securely held within the sheath against accidental withdrawal under a wide variety of circumstances. There is a need for a knife and sheath assembly which permits fast and simple withdrawal of the knife from the sheath, and equally fast and simple return of the knife to the sheath. There is a need for a knife and sheath assembly which is of simple design, light in weight, and has a minimum of mechanical components.

SUMMARY OF THE INVENTION

According to its major aspects, the present invention includes a knife and sheath assembly, the knife having a blade at one end and a hilt with a guard at the other end, the sheath having a closed portion adapted to receive the blade and an open portion adapted to abut the hilt and guard. A bolt biased by a spring is slidably contained within a channel inside the closed portion of the sheath. A portion of the bolt protrudes outwards from the channel and along the knife guard. A guide on the open portion of the sheath has a curved portion and a stepped portion. As the knife is inserted into the sheath, the guard rides over the curved portion and engages the bolt, pushing it from a locked position to an unlocked position. As the guard reaches the stepped portion of the guide, the guard and bolt disengage and the bolt can slide into the locked position, thus preventing accidental withdrawal of the knife. Pushing the bolt into the channel allows the knife to be withdrawn.

A feature of the invention is the cooperation of the bolt and the guide to allow the knife to be seated and secured in one motion with an audible and physically perceptible snap as the knife is pushed into the sheath by the user. The advantage of this feature is that it enables the user to secure the knife with one hand and in one motion and to know that the knife is secured, yet the knife is so positively locked that the knife will remain secure in the sheath even worn upside down. The sound and feel of the knife snapping into place is of especial advantage for use of the knife in underwater sports.

Another feature of the invention is the location of the bolt, which has the advantages of being convenient for operating to remove the knife by simply pressing on the bolt with the index finger and of being difficult to accidentally press.

Another feature of the present invention is that the spring biased bolt helps to lift the knife from the sheath when the bolt is pressed sufficiently and the hilt is moved over the bolt.

Yet another advantage of the invention is its simplicity of construction, having only the bolt as a moving part.

Other features and advantages inherent in the present invention will be apparent to those skilled in the art of knife and sheath assemblies. Reference is now made in detail to the present preferred embodiment of the invention, an example of which is given in the accompanying drawings.

A BRIEF DESCRIPTION OF THE DRAWINGS

The accompanying drawings, which are incorporated in and form a part of the specification, illustrate the invention and, together with the description, serve to explain the principles of the invention. In the drawings:

FIG. 1 shows a perspective view of an embodiment of the knife and sheath assembly of the present invention.

FIGS. 2*a* and 2*b* show front and side views, respectively, of the assembly according to an embodiment of the present invention.

FIGS. 3*a*, 3*b*, and 3*c* show a portion of the assembly of the present invention as embodied in FIG. 1 with the knife being inserted in stages.

FIG. 4 shows a side view of an alternate embodiment of the knife and sheath assembly according to the present invention.

FIGS. 5*a*, 5*b*, and 5*c* show a portion of the assembly of the present invention as embodied in FIG. 4 with the knife being inserted in stages.

DETAILED DESCRIPTION OF THE INVENTION

Figure 1:
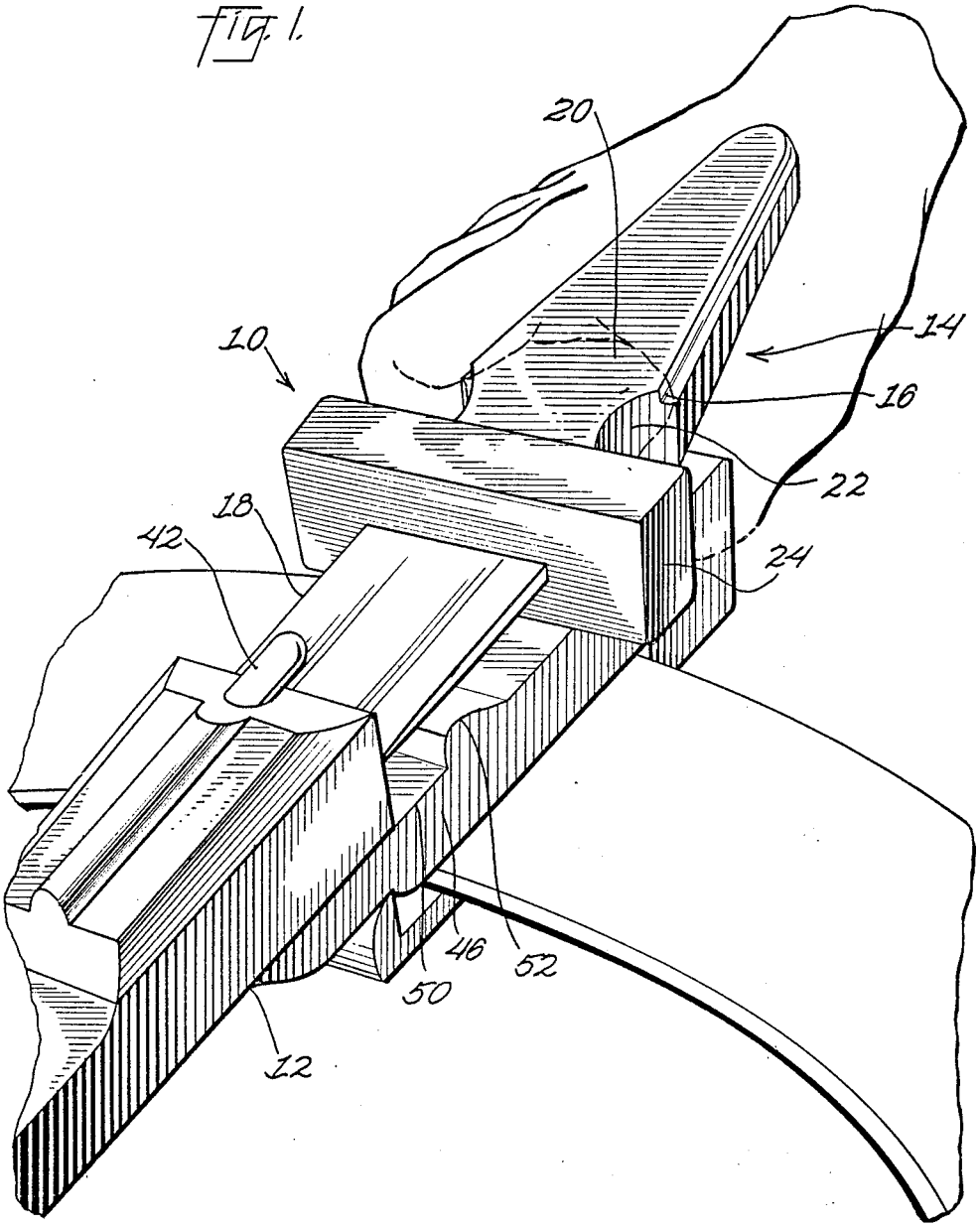

FIG. 1 shows a perspective view of knife and sheath assembly 10 of the present invention. Sheath 12 holds knife 14 having hilt 16 and blade 18. Hilt 16 includes handle 20, recessed portion 22, and guard 24. Blade 18, of any convenient shape and size, has one or more cutting edges and an integrally formed tang (not shown) encased within a recess in hilt 16.

Figure 2A:
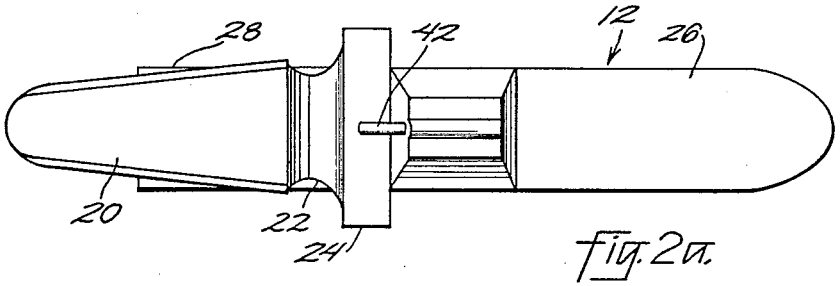
Figure 2B:
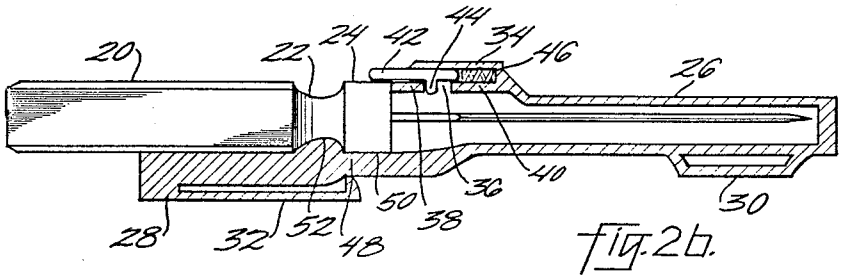

FIGS. 2*a* and 2*b* show front and side views of assembly 10, respectively. Sheath 12 has closed portion 26 enclosing blade 18, open portion 28, and suitable means such as loop 30 or clip 32 for supporting sheath 12 on a belt or the like. Alternatively, handle 20 may have a hole, loop, or other convenient means for supporting knife and sheath assembly 10. One embodiment of the securing mechanism for knife and sheath assembly 10 is illustrated in FIG. 2*b*.

Closed portion 26 has a channel 34 and an adjacent groove 36 with upper end 38 and lower end 40. A bolt 42 having a lateral tongue 44 and spring 46 are slidably incorporated within channel 34, spring 46 biasing bolt 42 out of channel 34, tongue 44 riding in groove 36 governing and limiting the travel of bolt 42 back and forth in channel 34 so that a major portion of bolt 42 protrudes from channel 34 when bolt 42 is in a locking position and a minor part of bolt 42 protrudes from channel 34 when bolt 42 is in an unlocking position. Open portion 28 has a guide 48 having stepped portion 50 and curved portion 52, configured, in a preferred embodiment, to accommodate guard 24 and indented section 22 of hilt 16, respectively.

When knife 14 is contained within sheath 12, recessed section 22 and guard 24 abut curved portion 52 and stepped portion 50, respectively (FIG. 2*b*), retained by bolt 42. Tongue 44 holds bolt 42 in channel 34 when in upper end 38 of groove 36.

Figure 3A:
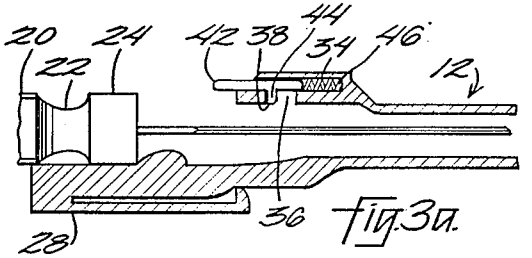

To remove the knife from the sheath, the user holds handle 20 in one hand while pressing bolt 42 downwards past the edge of guard 24 with the index finger of the same hand, thereby moving tongue 44 towards lower end 40 of groove 36 and compressing sPring 46 in channel 38. Upon release of bolt 42, knife 14 is released from sheath 12 by spring 46, and tongue 44 returns to its resting position against upper end 38 of groove 36 (FIG. 3*a*). Spring 46 has sufficient tension, in the preferred embodiment, to lift knife 14 outwards from sheath 12 at a comfortable rate for the user.

Figure 3B:
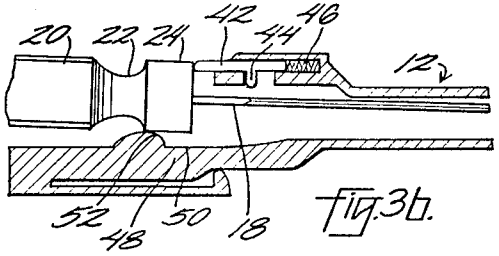
Figure 3C:
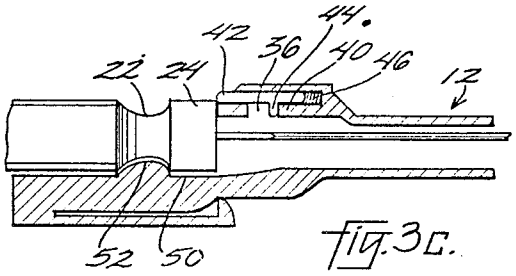

To return the knife to its sheath, the user holds handle 20 while inserting blade 18 into open portion 28 of sheath 12 (FIG. 3*a*). Guard 24 slides over curved portion 52 to settle into stepped portion 50 (FIG. 3*b*), while simultaneously guard 24 engages bolt 42 to urge bolt 42 from the locking position toward unlocking position, compressing spring 46 against lower end 40 of groove 36 until bolt 42 begins to slide out of engagement with guard 24 toward locking position, the guard moving rapidly into stepped portion 50 (FIG. 3*c*). In fully-seated position (FIG. 2*b*), guard 24 rests in stepped portion 50 of sheath 12, and bolt 42 rests against guard 24, guide 48 and bolt 42 cooperating to secure knife 14 in sheath 12.

Guard 24 of knife 14 is of some convenient width, which may be wider or narrower than the opening of sheath 12. Bolt 42 and guard 24 are shaped so that bolt 42 facilitates the movement of guard 24 when knife 14 is removed from, or returned to, sheath 12. Assembly 10 may be of any convenient size, but is preferably dimensioned to be readily attached to a belt, shoulder harness or carried in a pocket.

Figure 4:
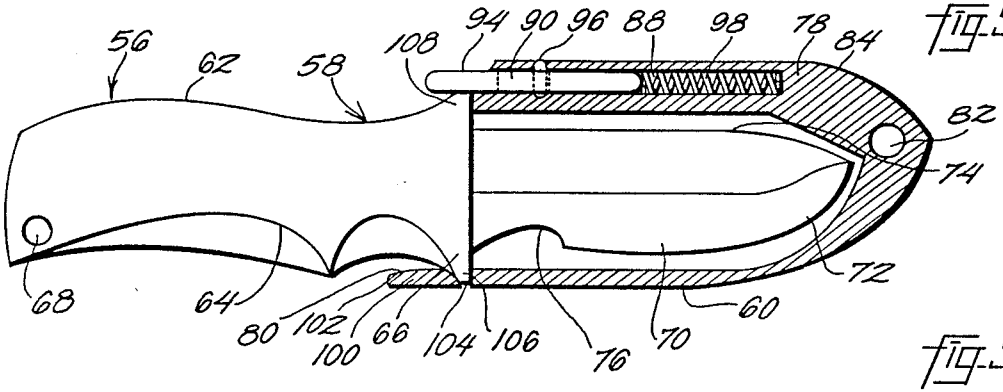

An alternative embodiment of a knife and sheath assembly 56 according to the present invention is shown in FIG. 4. Sheath 60 holds knife 58 having hilt 62 with indentations 64 and guard 66. Indentations 64 are configured to substantially accommodate the fingers of the user. Hilt 62 may, if convenient, include a hole 68 or some other means for supporting knife 58 on a belt or the like. Blade 70, of any convenient shape and size, has edge 72, false edge 74, and an integrally formed tang (not shown) encased within hilt 62. Blade 70 may have two edges, perhaps one of them serrated, as desired, and edge 72 of blade 70 may include an indentation 76.

Sheath 60 has closed portion 78 enclosing blade 70, and open portion 80. Sheath 60 may, if convenient, also have a hole 82 for supporting sheath 60 on a belt or the like by a clip such as that more fullY described below.

As an alternative locking mechanism to that described above and illustrated in FIGS. 2 and 3, FIGS. 4, 5 and 6 show a locking mechanism in which a groove 90 is made in bolt 94, as best seen in FIG. 6. A pin 96 is firmly attached to top edge 84 and projects into a channel 88 where it rides in groove 90 as pin 96 slides back and forth to govern the action of bolt 94. Pin 96 rides in groove 90 to govern and limit the travel of bolt 94 so that at one extreme of groove 90, bolt 94 protrudes a major part of its length from channel 88 and at the other extreme, bolt 94 protrudes a minor part from channel 88.

As shown in FIG. 4, sheath 60 has an extension 100 including curved portion 102 and stepped portion 104. Stepped portion 104 is of a size and shape to accommodate guard 66 of knife 58 and is preferably a slot through extension 100 for increased security.

When knife 58 is contained within sheath 60, bottom edge 106 of guard 66 rests in stepped portion 104. Bolt 94 rests against top edge 108 of guard 66, pin 96 is at one extreme end of groove 90, and spring 98 is under tension sufficient to hold bolt 94 in place.

To remove the knife from the sheath, the user holds hilt 62 in one hand while pressing bolt 94 downwards past top edge 108 of guard 66 with the index finger of the same hand, thereby compressing spring 98. Upon release of bolt 94, knife 58 is lifted outwards from sheath 60 by bolt 94 biased by spring 98, and bolt 94 returns to its locking position (FIG. 5*a*).

Figure 5A:
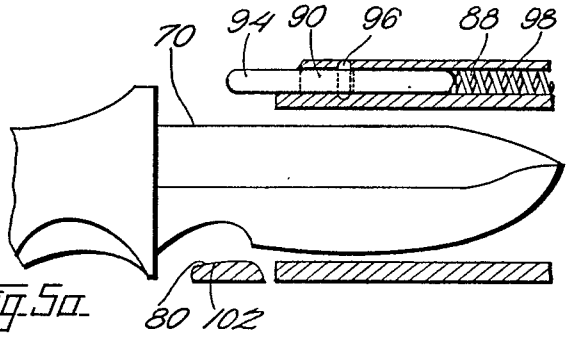
Figure 5B:
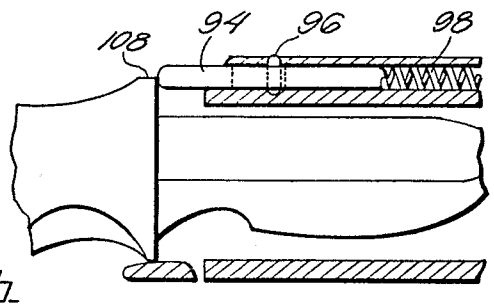
Figure 5C:
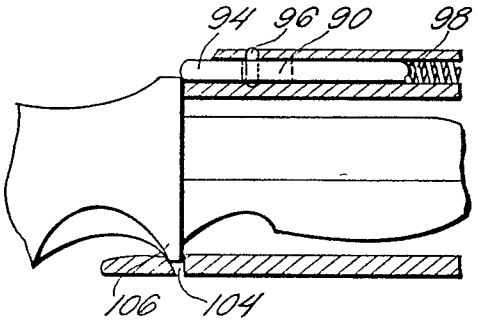
Figure 6:
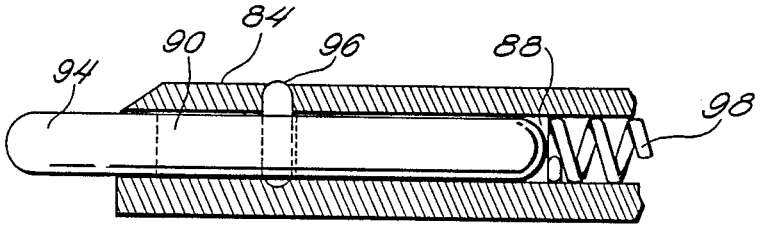
FIG. 6 is a detailed view of the bolt and pin arrangement according to an embodiment of the present invention.

FIGS. 5*a*, 5*b*, and 5*c* show the sequence of the return of knife 58 to fully seated position in sheath 60 of FIG. 4. The user inserts blade 70 into open portion 80 of sheath 60 (FIG. 5*a*). As bottom edge 106 of guard 66 glides over curved portion 102, top edge 108 moves bolt 94, compressing spring 98 (FIG. 5*b*). Pin 96 moves towards an extreme end of groove 90, as bottom edge 106 of guard 66 slides towards stepped portion 104 of sheath 60 (FIG. 5*c*). As it approaches fully-seated position, bottom edge 106 enters stepped portion 104 and bolt 94 rests against top edge 108. Pin 96 moves finally to the other extreme of groove 90 holding bolt 94 in locking position as shown in FIG. 4.

Bolt 94 and guard 66 are shaped so that bolt 94 facilitates the movement of guard 66 when knife 58 is removed from, or returned to, sheath 60. Bolt 94 is shaped and positioned to meet guard 66 as it is guided by guide 100 onto curved portion 102 and direct guard 66 into stepped portion 104.

Assembly 56 may be of any convenient size, for example, dimensioned to be readily carried within a pocket. Blade 70 maY, for example, be approximately 2 inches long having an edge 72 suitably curved for use in skinning game or having a serrated edge at 74.

Figure 7:
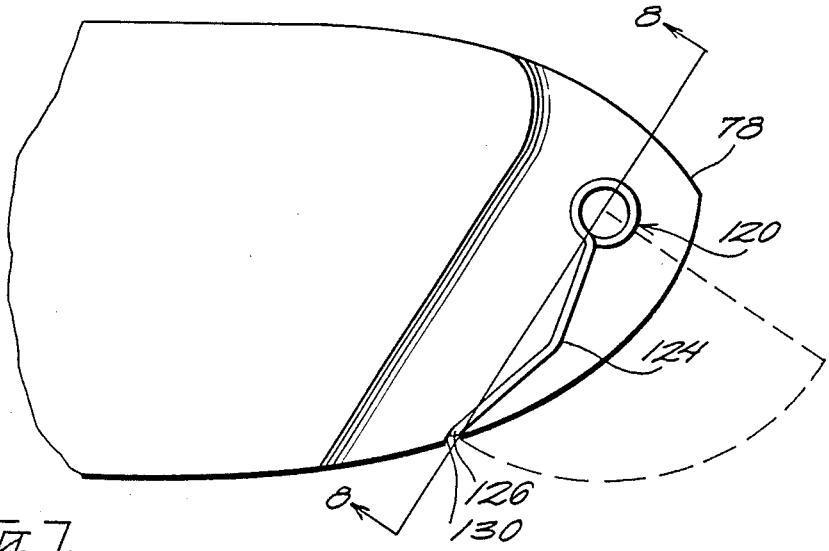
FIGS. 7 is a detailed side view of an embodiment of the end of the knife sheath showing a clip for attaching the sheath.
Figure 8:
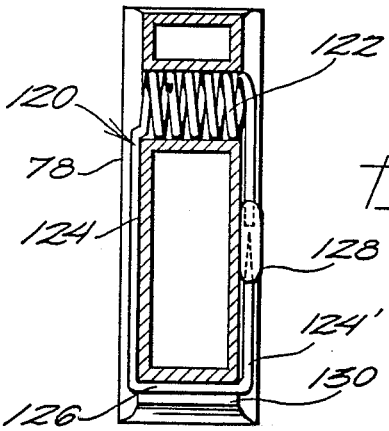
FIG. 8 is a cross sectional detail of FIG. 7 along line 8—8 showing the clip.

FIGS. 7 and 8 illustrate an embodiment for a clip 120 for knife and sheath assembly 56 that fits into hole 82 and conforms to the external contours of closed portion 78. As best seen in FIG. 8, clip 120 has a coil 122 to provide spring action. Two members 124 and 124', on either side of closed portion 78 of sheath 60, terminate in end 126. The ends of members 124 and 124' meet at closure 128. End 126 fits into cut 130 along sheath 60 for storing when clip 120 is not in use. So stored, clip 120 will not readily catch on other objects. When it is desired to attach knife and sheath assembly 56 to a shirt, harness or the like, clip 120 is swung from its stored position, as indicated in FIG. 7, and pinned. Knife and sheath assembly 56 may easily be attached so that it hangs upside down because knife 58 is secure in sheath 60.

In both embodiments described above, the hilt, sheath, and bolt may be made of a wide range of materials, but are preferably molded of a rigid material such as Nylon. The spring is made of some material having high corrosion resistance and high springability, such as Inconel or the like. The blade may, if convenient, be coated with "TEFLON", a registered trademark of E.I. Dupont de Nemours & Co. (Inc.), or similar material and heat-treated to improve its cuttability and lubricity. The clip is preferably made of tempered steel.

It will be obvious that the present arrangement may be adapted for tools other than knives that may be worn in a sheath or holster where security and rapid access to the knife and the like may both be desirable characteristics.

The present invention provides a knife and sheath assembly wherein the knife is secured within the sheath against accidental withdrawal when worn by the user, for example attached to a belt or placed in a pocket, and also when packed with other equipment. This assembly permits rapid and simple one-step withdrawal of the knife from the sheath, and equally expeditious return of the knife to the sheath. The assembly, which is of simple design, can be fabricated of lightweight materials, and has a minimum of mechanical components, thus simplifying manufacture and maintenance and maximizing durability.

The foregoing description of preferred embodiments of the invention has been presented for purposes of illustration and description. It is not intended to be exhaustive or to limit the invention to the precise form disclosed, and obviously many modifications and variations are possible in light of the above teachings. The embodiments were chosen and described in order to best explain the principles of the invention and its practical application to therebY enable one skilled in the art to best utilize the invention in various embodiments and with various modifications as are suited to the particular use contemplated. It is intended that the scope of the invention be defined by the claims appended hereto.

What is claimed is:

1. In a combination of a sheath and a knife, or the like, an assembly comprising:

a knife having
- a blade at one end, and
- a hilt with a guard at an opposing end, said guard adjacent said blade;

a sheath having
- a closed end dimensioned to receive said blade, and
- an open end;

said closed end having
- a channel,
- a slidable bolt in said channel, and
- a spring in said channel biasing said bolt out of said channel;

said open end having
- a curved portion, and
- an adjacent stepped portion;

said guard riding over said curved portion as said knife is inserted into said closed end, said guard pushing said bolt into said channel against said spring until said guard slips into said stepped portion, said bolt then sliding over said guard to secure said knife in said sheath.

2. The assembly of claim 1 wherein said bolt has a groove and said channel has a pin extending thereinto in engagement with said groove of said bolt, said bolt slidable back and forth on said pin, said pin governing and limiting the motion of said bolt in said channel.

3. The assembly of claim 1 wherein said bolt has an integral tongue and said channel has a groove, said tongue of said bolt protruding into said groove and slidable back and forth in said groove, said groove governing and limiting the motion of said bolt in said channel.

4. The assembly of claim 1 wherein said sheath further comprises:

a clip for attaching said sheath to a belt and the like, said clip having a stored position and an open position; and a means for storing said clip in said stored position.

5. In a combination of a sheath and a knife, an assembly comprising:

a knife having
- a blade at one end, and
- a hilt with a guard an opposing end, said guard having a side and a bottom adjacent said blade;

a sheath having
- a closed end dimensioned to receive said blade, and
- an open end;

means integral with said open end of said sheath for guiding said knife into said closed end, said guiding means having a curved portion and an adjacent stepped portion;

means for locking said knife in said sheath, said locking means incorporated in said sheath and having a slidable bolt carried by said closed end, said bolt having a locking position and an unlocking position, and means for biasing said bolt toward said locking position and from said unlocking position,
- said bolt preventing withdrawal of said knife when said bolt is in said locking position,
- said bolt allowing withdrawal of said knife when said bolt is in said unlocking position, said curved portion guiding said guard toward said bolt, said bottom of said guard engaging said bolt and sliding said bolt into said unlocking position, said stepped portion guiding said guard away from said bolt, said bottom of said guard disengaging said bolt and said biasing means urging said bolt to slide to said locking position and to engage said side of said guard.

6. The assembly of claim 5 wherein said sheath further comprises:

a channel integral with said closed end of said sheath, said bolt slidable within said channel.

7. The assembly of claim 6 wherein said bolt has a groove and said channel has a pin extending thereinto in engagement with said groove of said bolt, said bolt slidable back and forth on said pin, said pin governing and limiting the motion of said bolt in said channel.

8. The assembly of claim 6 wherein said bolt has an integral tongue and said channel has a groove, said tongue of said bolt protruding into said groove and slidable back and forth in said groove, said groove governing and limiting the motion of said bolt in said channel.

9. The assembly of claim 5 wherein said sheath further comprises:

a clip for attaching said sheath to a belt and the like, said clip having a stored position and an open position; and means for storing said clip in said stored position.

10. A sheath for use with a knife having a blade and a hilt, the hilt having a guard with a bottom and a side, said sheath comprising:

a sheath having a closed end dimensioned to receive said blade, and an open end;

means integral with said open end of said sheath for guiding said knife into said closed end, said guiding means having a curved portion and an adjacent stepped portion;

means for locking said knife in said sheath, said locking means incorporated in said sheath and having a slidable bolt carried by said closed end, said bolt having a locking position and an unlocking position, and means for biasing said bolt toward said locking position and from said unlocking position, said bolt preventing withdrawal of said knife when said bolt is in said locking position, said bolt allowing withdrawal of said knife when said bolt is in said unlocking position, said curved portion guiding said guard toward said bolt, said bottom of said guard engaging said bolt and sliding said bolt into said unlocking position, said stepped portion guiding said guard away from said bolt, said bottom of said guard disengaging said bolt and said biasing means urging said bolt to slide to said locking position and to engage said side of said guard.

11. The sheath of claim 10 wherein said sheath further comprises:

a channel integral with said closed end of said sheath, said bolt slidable within said channel.

12. The sheath of claim 11 wherein said bolt has a groove and said channel has a pin extending thereinto in engagement with said groove of said bolt, said bolt slidable back and forth on said pin, said pin governing and limiting the motion of said bolt in said channel.

13. The sheath of claim 11 wherein said bolt has an integral tongue and said channel has a groove, said tongue of said bolt protruding into said groove and slidable back and forth in said groove, said groove governing and limiting the motion of said bolt in said channel.

14. The sheath of claim 10 wherein said sheath further comprises:

a clip for attaching said sheath to a belt and the like, said clip having a stored position and an open position; and means for storing and clip in said stored position.

* * * * *